US009705248B1

(12) United States Patent
Ko

(10) Patent No.: US 9,705,248 B1
(45) Date of Patent: Jul. 11, 2017

(54) DOCKING STRUCTURE OF PUSH-AND-LOCK ELECTRICAL CONNECTOR

(71) Applicants: KUNSHAN AMPHENOL ZHENGRI ELECTRONICS CO., LTD., Kunshan, Jiangsu Province (CN); Amphenol LTW Technology Co., Ltd., New Taipei (TW)

(72) Inventor: Kun-Te Ko, New Taipei (TW)

(73) Assignees: KUNSHAN AMPHENOL ZHENGRI ELECTRONICS CO., LTD., Kunshan, Jiangsu Province (CN); AMPHENOL LTW TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/333,187

(22) Filed: Oct. 25, 2016

(30) Foreign Application Priority Data

Jul. 14, 2016 (TW) ..... 105122298 A

(51) Int. Cl.
*H01R 13/627* (2006.01)
*H01R 13/639* (2006.01)

(52) U.S. Cl.
CPC ..... *H01R 13/6275* (2013.01); *H01R 13/639* (2013.01)

(58) Field of Classification Search
CPC ..... H01R 13/6275; H01R 13/6273; H01R 13/6272; H01R 13/639; H01R 13/641
USPC ..... 439/352, 348, 349, 350
See application file for complete search history.

(56) References Cited

U.S. PATENT DOCUMENTS 4,017,139 A * 4/1977 Nelson ..... F16L 37/133 285/316
4,545,633 A * 10/1985 McGeary ..... H01R 13/6277 439/141
4,548,455 A * 10/1985 Ezure ..... H01R 13/627 439/152
6,179,641 B1 * 1/2001 Kaneko ..... H01R 13/6277 439/349

(Continued)

FOREIGN PATENT DOCUMENTS

CN 1901293 A 1/2007
TW M523778 U 6/2016

OTHER PUBLICATIONS

Office Action dated Mar. 16, 2017 of the corresponding Taiwan patent application.

*Primary Examiner* — Abdullah Riyami
*Assistant Examiner* — Vladimir Imas
(74) *Attorney, Agent, or Firm* — Chun-Ming Shih; HDLS IPR Services

(57) ABSTRACT

A docking structure of a push-and-lock electrical connector includes a first connector, a second connector, and a locking part used to lock the first and second connectors. The locking part has at least one flexible locking arm having a locking portion and a latching block extending from the locking portion and protruding into the mouth of the second connector. An elastic spacing is formed between the latching block and the flexible locking arm. Thus, when the first connector is inserted into the mouth of the second connector, the latching block is latched in the latch groove of the first connector and an inner wall of the sliding shell sleeved around the second connector is pressed against the locking portion.

10 Claims, 8 Drawing Sheets

(56) References Cited

U.S. PATENT DOCUMENTS

| | | | | |
|---|---|---|---|---|
| 6,910,910 | B2 * | 6/2005 | Cairns | G02B 6/3816 174/13 |
| 7,322,846 | B2 * | 1/2008 | Camelio | H01R 13/6277 439/352 |
| 7,429,193 | B2 * | 9/2008 | Cairns | H01R 13/521 439/271 |
| 8,292,645 | B2 * | 10/2012 | Cairns | H01R 13/523 439/271 |
| 8,981,223 | B2 * | 3/2015 | Kim | B60R 16/0215 174/74 R |
| 9,570,853 | B1 * | 2/2017 | Yu | H01R 13/639 |

* cited by examiner

DOCKING STRUCTURE OF PUSH-AND-LOCK ELECTRICAL CONNECTOR

BACKGROUND OF THE INVENTION

Field of the Invention

The present invention relates to an electrical connector and in particular to a docking structure of a push-and-lock electrical connector applicable to a cable.

Description of Prior Art

The connecting types of the traditional electrical connectors used for the docking connection of cables mainly include quick disconnect, twist-and-lock, and thread compression to achieve the purpose of connector docking.

However, although the most convenient connecting type used in the above traditional electrical connectors is quick disconnect type, the connection effect cannot be ensured, and the problem of separation of the docked connectors which may be caused by careless pulling due to external force or vibration cannot be solved either. In addition, the electrical connector of twist-and-lock or thread compression type which needs extra structure usually occupies additional space and thus is not applicable to the situations with confined space, which easily and directly or indirectly causes the users (or the product designers) to restrict a good design due to the limitation on the existing specifications and functions.

In view of this, the inventor pays special attention to research with the application of related theory and tries to improve and overcome the above disadvantages regarding the above related art, which becomes the improvement target of the inventor.

SUMMARY OF THE INVENTION

The main objective of the present invention is to provide a docking structure of a push-and-lock electrical connector, which makes the use of the electrical connector more convenient and effectively enables the electrical connector to have high pulling resistance. Thus, the present invention can be installed in various situations with confined space and facilitates the installation and maintenance.

To achieve the above objective, the present invention provides a docking structure of a push-and-lock electrical connector, which comprises a first connector, a second connector, and a locking part. The first connector has a first body, a first docking portion extending from a front end of the first body. An outer wall of the first docking portion is provided with a latch groove. The second connector has a second body, a sliding shell sleeved around the second body, and an elastic part disposed between the second body and the sliding shell. A second docking portion is disposed at a front end of the second body and has a mouth engaged with the first docking portion with an insertion fit and is provided with at least one locking hole. The locking part is disposed on the second docking portion and between the second body and the sliding shell. The locking part has at least one flexible locking arm having a locking portion with a front end corresponding to an inner edge of the locking hole and a latching block extending from the locking portion and protruding into the mouth. An elastic spacing is formed between the latching block and the flexible locking arm. In this way, when the first docking portion is inserted into the mouth, the latching block is latched in the latch groove and an inner wall of the sliding shell is pressed against the locking portion.

DETAILED DESCRIPTION OF THE INVENTION

The detailed description and technical details of the present invention will be explained below with reference to accompanying figures. However, the accompanying figures are only for reference and explanation, but not to limit the scope of the present invention.

Figure 1:
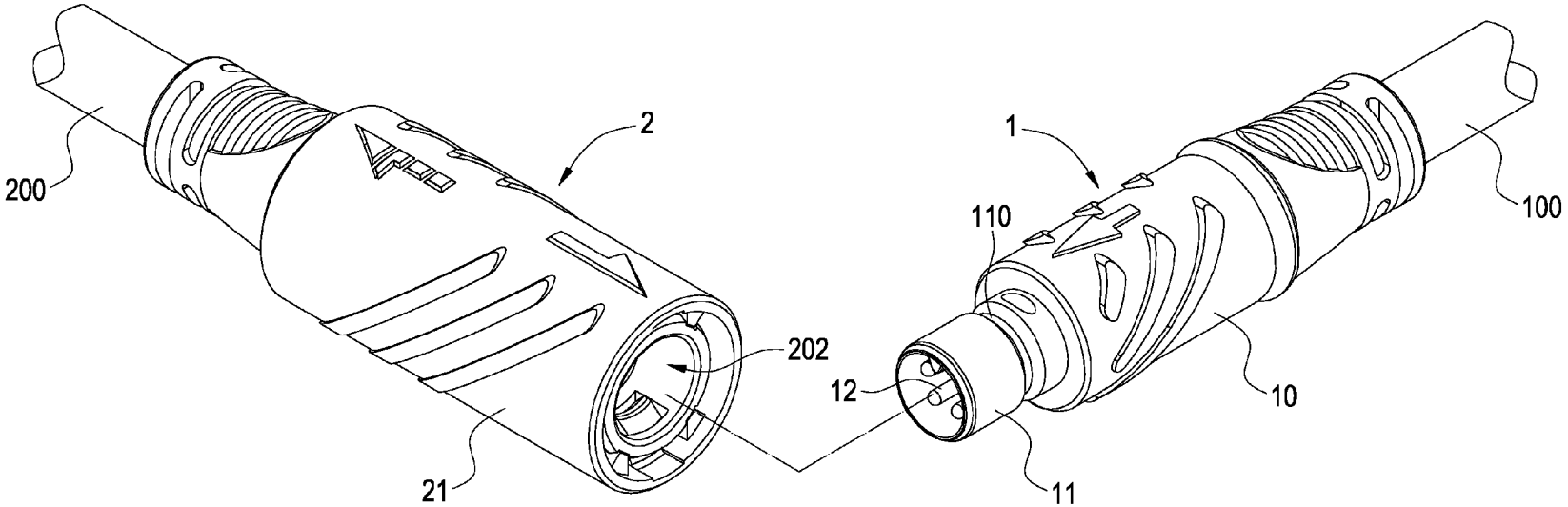
FIG. 1 is a perspective view of the first and second connectors of the present invention, which are not docked to each other.

Please refer to FIG. 1, which is a perspective view of the first and second connectors of the present invention; the first and second connectors are not docked to each other. The present invention provides a docking structure of a push-and-lock electrical connector, which comprises a first connector 1, a second connector 2 docking to the first connector 1, and a locking part 3 (shown in FIG. 2) used to lock the first and second connectors 1, 2 after the first connector 1 is docked to the second connector 2.

The first connector 1 has a first body 10, a first docking portion 11 extending from the front end of the first body 10. The rear end of the first body 10 is used to connect a cable 100. Plural terminal pins 12 can be disposed in the first docking portion 11 for electrical connection when the second connector 2 is docked. Besides, the outer wall of the first docking portion 11 is provided with a latch groove 110 which has a ring shape to surround the edge of the outer wall of the first docking portion 11. The latch groove 110 has a trapezoidal shape with a recess in longitudinal cross-section having a first groove slope 111 and a second groove slope 112.

Figure 2:
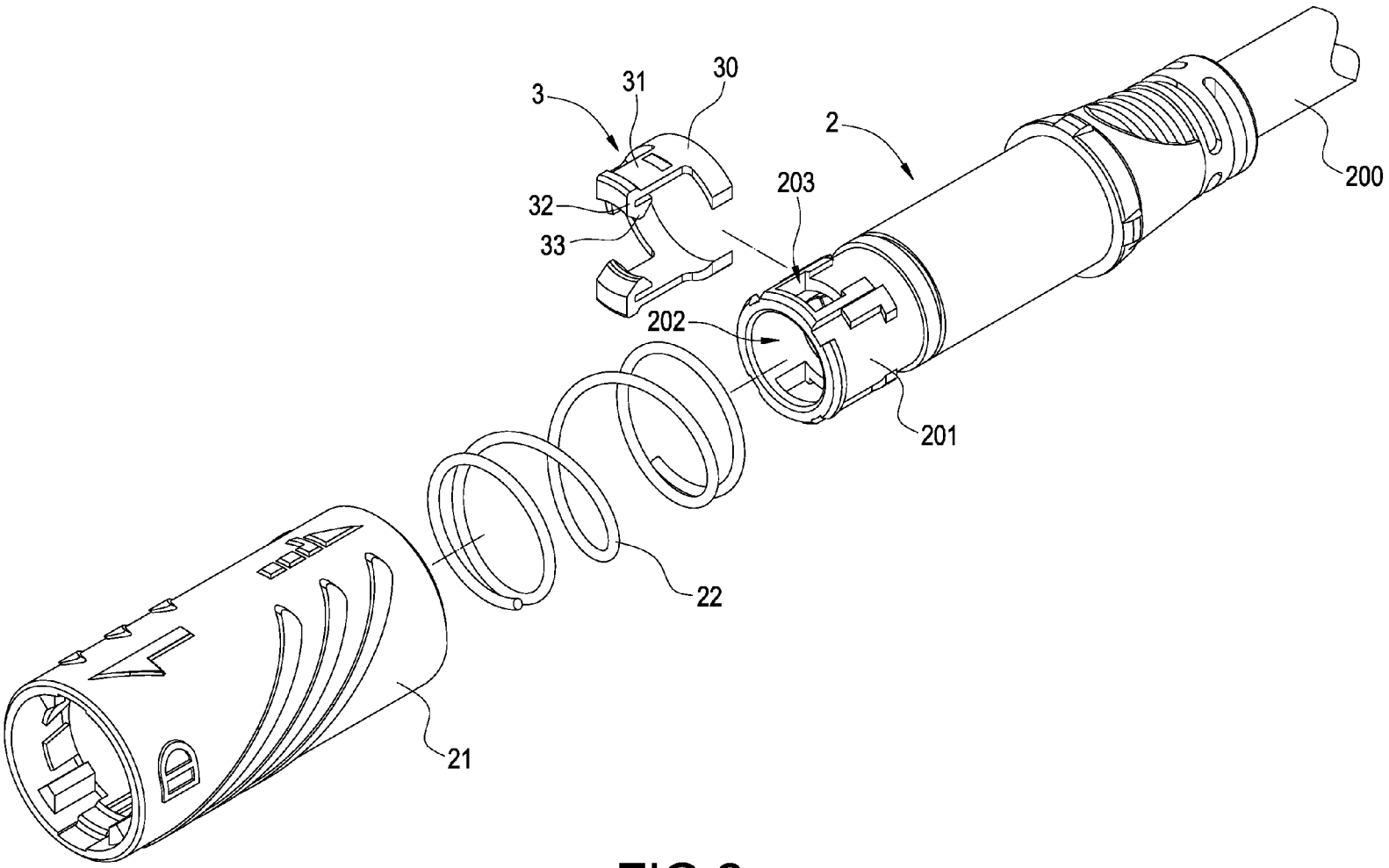
FIG. 2 is a perspective exploded view of the second connector of the present invention.
Figure 3:
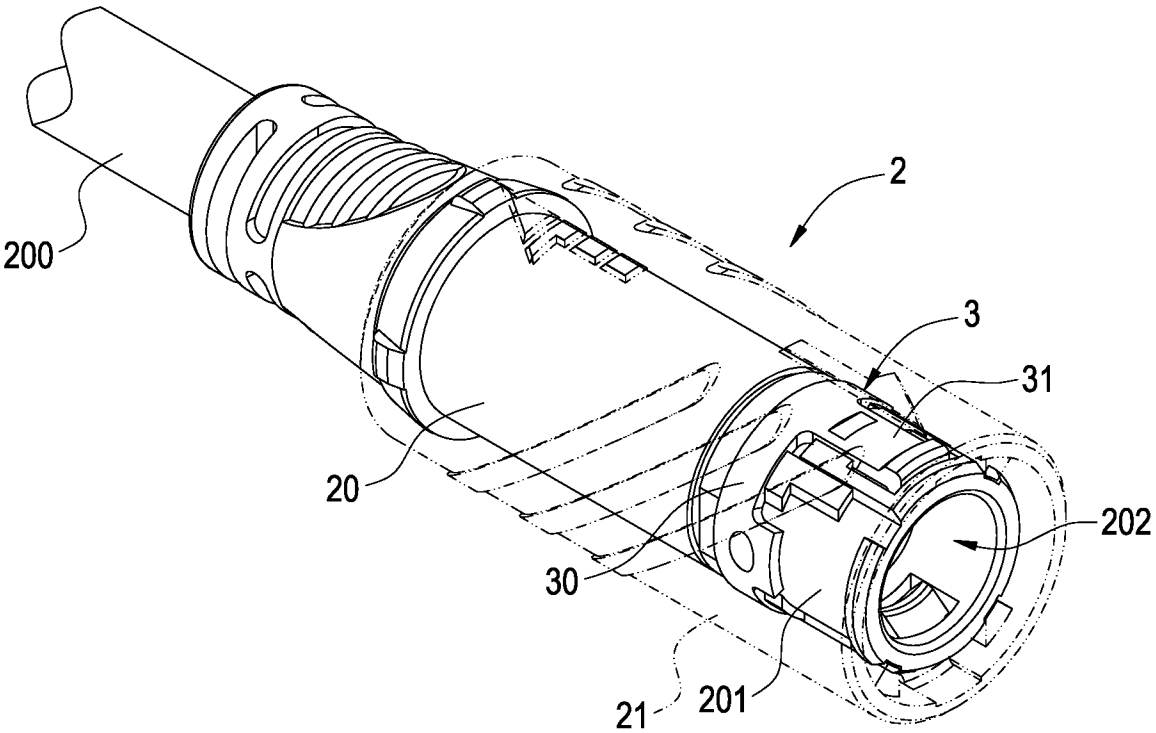
FIG. 3 is a perspective assembled view of the second connector of the present invention.

The second connector 2 is used to dock to the first connector 1. As shown in FIGS. 2 and 3, the second connector 2 has a second body 20, a sliding shell 21 sleeved around the second body 20, and an elastic part 22 disposed between the second body 20 and the sliding shell 21. The rear end of the second body 20 is also used to connect another cable 200. A second docking portion 201 is disposed at the front end of the second body 20 and has a mouth 202 engaged with the first docking portion 11 of the first connector 1 with an insertion fit such that the first and second connectors 1, 2 can dock to each other. Moreover, the sliding shell 21 can be pushed manually against the elastic part 22 toward the rear end of the second body 20 and can be restored back to the original position by the spring force of the elastic part 22 after the pushing force is released.

Figure 4:
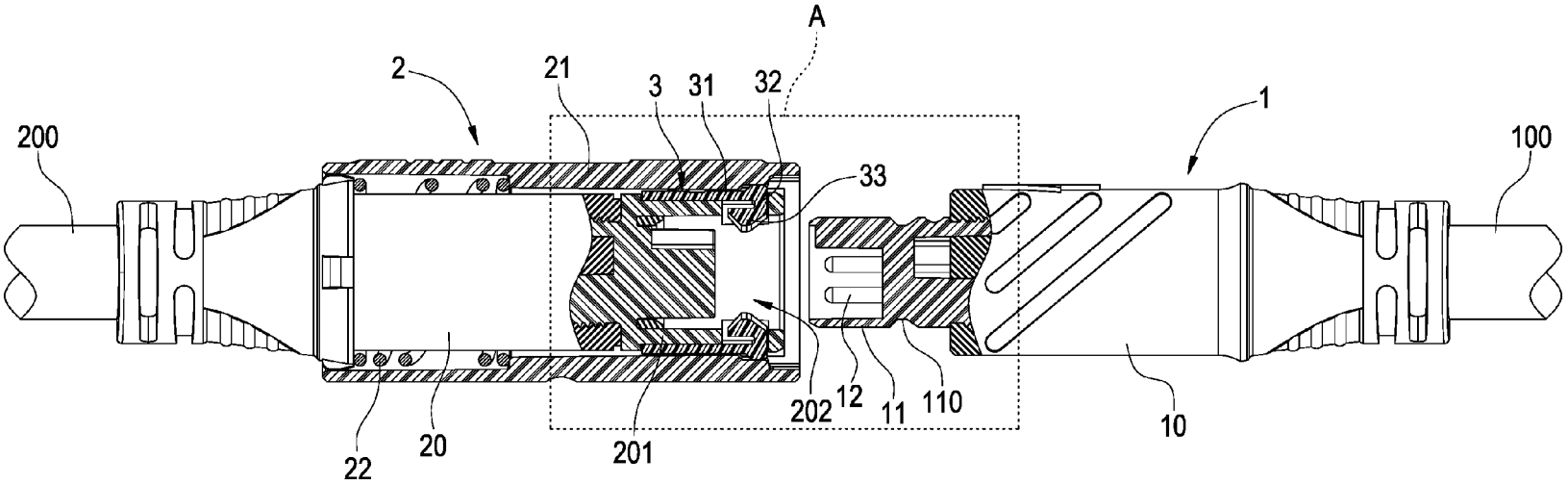
FIG. 4 is a partial longitudinal cross-sectional view of the first and second connectors of the present invention before the docking.
Figure 5:
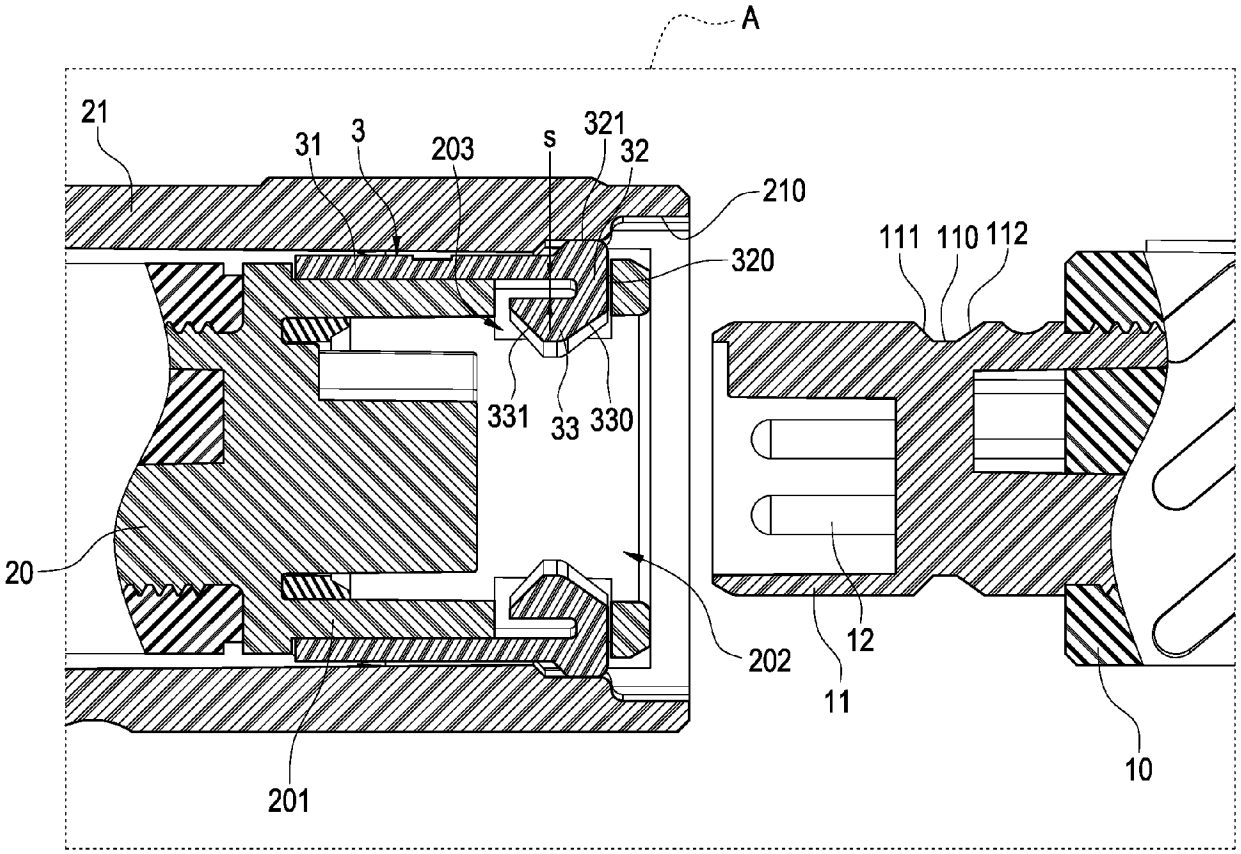
FIG. 5 is an enlarged detailed view of region A in FIG. 4.

Please also refer to FIGS. 4 and 5. The present invention is characterized that the locking part 3 disposed on the second connector 2 provides the first and second connectors 1, 2 with further latching and prevents them from being separated after they are docked to each other. The locking part 3 is disposed on the second docking portion 201 of the second connector 2 and between the second body 20 and the sliding shell 21. In an embodiment of the present invention, the locking part 3 comprises a ring body 30 and at least one flexible locking arm 31 extending from the ring body 30 axially. The ring body 30 can be shaped like a letter "C" such that the locking part 3 can clamp the second docking portion 201. Also, the second docking portion 201 is provided with at least one locking hole 203. Each flexible locking arm 31 has a locking portion 32 with a front end corresponding to the inner edge of the locking hole 203 and a latching block 33 extending from the locking portion 32 and protruding into the mouth 202 of the second docking portion 201 such that an elastic spacing S is formed between the latching block 33 and the flexible locking arm 31. Additionally, the latching block 33 has a trapezoidal shape with a protrusion in longitudinal cross-section having a first block slope 330 and a second block slope 331.

Figure 6:
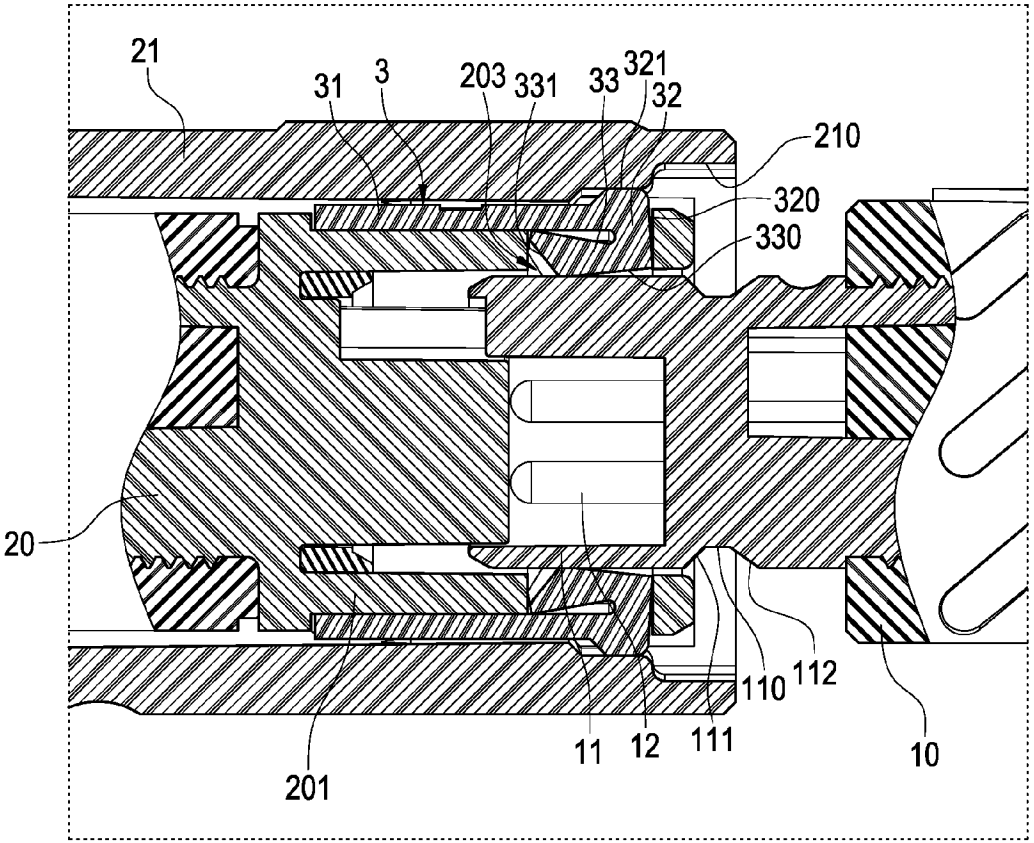
FIG. 6 is a schematic view of the first and second connectors during the docking process according to FIG. 5.

Thus, as shown in FIGS. 5 and 6, because of the elastic spacing S formed between the latching block 33 of the locking part 3 and the flexible locking arm 31, when the first and second connectors 1, 2 are docked to each other, the latching block 33 will be pressed by the first docking portion 11 of the first connector 1 to deform toward the elastic spacing S such that the first docking portion 11 can be inserted completely into the mouth 202 to achieve the docking between the first and second connectors 1, 2 without pushing the sliding shell 21 of the second connector 2. Therefore, the present invention can facilitate the installation and maintenance to decrease the process time.

Figure 7:
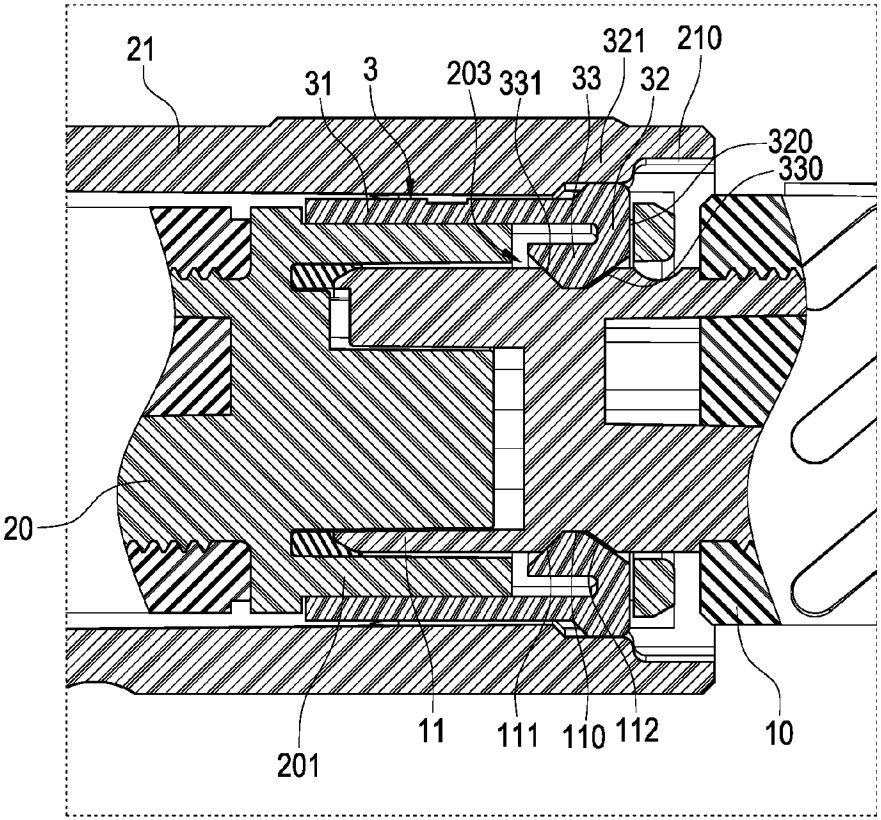
FIG. 7 is a schematic view of the first and second connectors after the docking process is completed according to FIG. 5.

As shown in FIG. 7, when the first docking portion 11 of the first connector 1 is inserted completely into the mouth 202, the latching block 33 of the locking part 3 slides into the latch groove 110 through the first block slope 330 and along the first groove slope 111 such that the latching block 33 is latched in the latch groove 110 of the first docking portion 11. Also, the inner wall of the sliding shell 21 is still pressed against the locking portion 32 to prevent the latching block 33 from being released from the latch groove 110. In more detail, because the locking portion 32 falls into the locking hole 203 such that the front end 320 of the locking portion 32 corresponds to the inner edge of the locking hole 203 and the outer side 321 of the locking portion 32 is limited by the pressure of the inner wall of the sliding shell 21, there is no space for the flexible locking arm 31 to deform outward or bend to let the latching block 33 be released from the latch groove 110. Therefore, when the first and second connectors 1, 2 are docked to each other, the resultant high pulling resistance can prevent the separation of the first and second connectors 1, 2. Furthermore, because the locking part 3 is located between the first and second connectors 1, 2 after the docking, the external space is not occupied and thus the present invention can be applicable to the situations with confined space.

Figure 8:
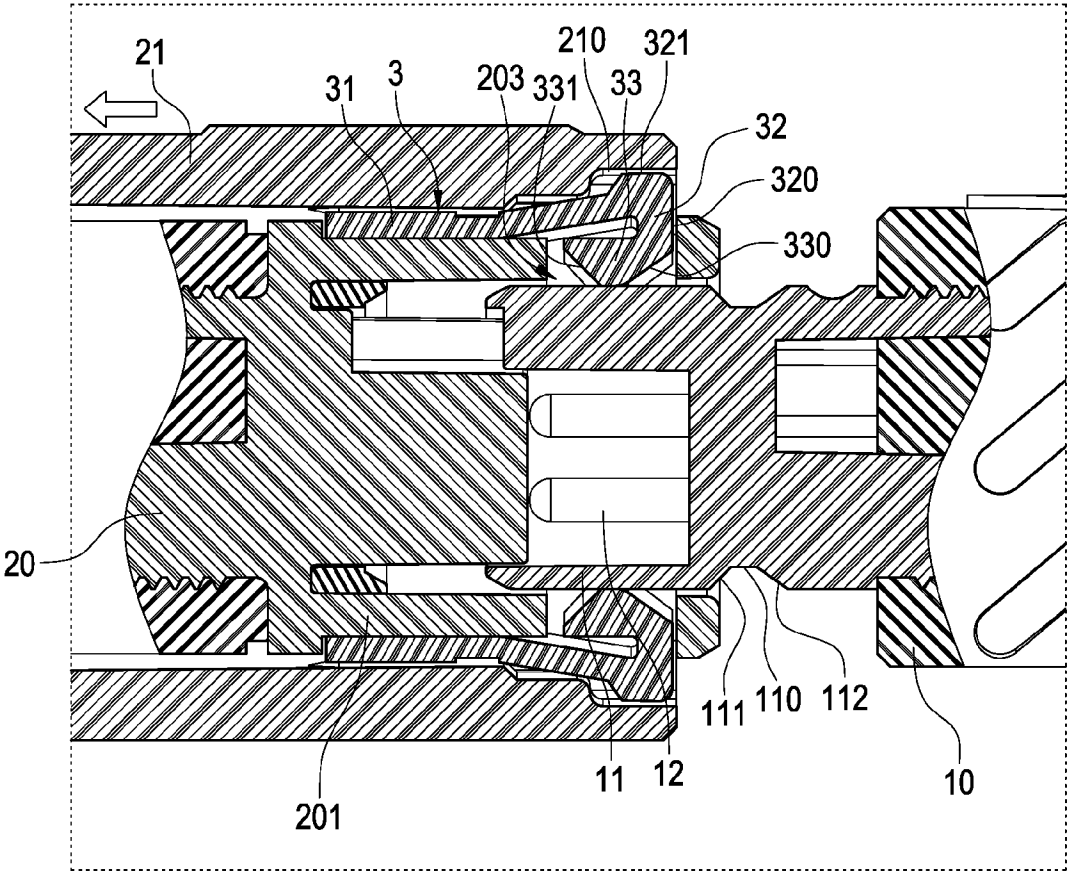
FIG. 8 is a schematic view of the first and second connectors during the separation process according to FIG. 5.

Moreover, as shown in FIG. 8, when the first and second connectors 1, 2 want to be separated from each other, the user only push back the sliding shell 21 of the second connector 2 to separate the first and second connectors 1, 2 manually. In an embodiment of the present invention, a withdrawal groove 210 is disposed surrounding the inner wall of the front end of the sliding shell 21 and has an inner diameter larger than that of the sliding shell 21. When the first docking portion 11 of the first connector 1 is released from the mouth 202 of the second connector 2, the first docking portion 11 immediately lifts the latching block 33 of the locking part 3 away from the latch groove 110 and pushes the latching block 33 outward and radially such that the flexible locking arm 31 deforms to move the locking portion 32 back to the withdrawal groove 210. Meanwhile, the latching block 33 can deform easily by reducing the distance to the flexible locking arm 31 by means of the elastic spacing S and further the first docking portion 11 can be quickly released from the mouth 202 to separate the first and second connectors 1, 2.

Thus, by means of the combination of the above structures, the docking structure of a push-and-lock electrical connector of the present invention can be obtained.

In summary, the present invention indeed achieves the expected objective and overcomes the disadvantages of the prior art. Also, it is indeed novel, useful, and non-obvious to be patentable. Please examine the application carefully and grant it as a formal patent for protecting the rights of the inventor.

The embodiments disclosed in the above description are only preferred embodiments of the present invention, but not to limit the scope of the present invention. The scope of the present invention should be embraced by the accompanying claims and includes all the equivalent modifications and not be limited to the previous description.

What is claimed is:

1. A docking structure of a push-and-lock electrical connector, comprising:

a first connector having a first body, a first docking portion extending from a front end of the first body, wherein an outer wall of the first docking portion is provided with a latch groove;

a second connector having a second body, a sliding shell sleeved around the second body, and an elastic part disposed between the second body and the sliding shell, wherein a second docking portion is disposed at a front end of the second body and has a mouth engaged with the first docking portion with an insertion fit and is provided with at least one locking hole; and a locking part disposed on the second docking portion and between the second body and the sliding shell, wherein the locking part has at least one flexible locking arm having a locking portion with a front end corresponding to an inner edge of the locking hole and a latching block extending from the locking portion and protruding into the mouth, wherein an elastic spacing is formed between the latching block and the flexible locking arm, whereby when the first docking portion is inserted into the mouth, the latching block is latched in the latch groove and an inner wall of the sliding shell is pressed against the locking portion.

2. The docking structure of a push-and-lock electrical connector according to claim 1, wherein a cable is connected to a rear end of the first body.

3. The docking structure of a push-and-lock electrical connector according to claim 2, wherein another cable is connected to a rear end of the second body.

4. The docking structure of a push-and-lock electrical connector according to claim 1, wherein the latch groove has a ring shape to surround an edge of an outer wall of the first docking portion.

5. The docking structure of a push-and-lock electrical connector according to claim 4, wherein the latch groove has a trapezoidal shape with a recess in longitudinal cross-section.

6. The docking structure of a push-and-lock electrical connector according to claim 4, wherein the latching block has a trapezoidal shape with a protrusion in longitudinal cross-section.

7. The docking structure of a push-and-lock electrical connector according to claim 1, wherein a withdrawal groove is disposed surrounding the inner wall of the front end of the sliding shell and has an inner diameter larger than that of the sliding shell.

8. The docking structure of a push-and-lock electrical connector according to claim 1, wherein the locking part further comprises a ring body, wherein the flexible locking arm extends from the ring body.

9. The docking structure of a push-and-lock electrical connector according to claim 8, wherein the flexible locking arm is plural in number.

10. The docking structure of a push-and-lock electrical connector according to claim 8, wherein the ring body is shaped like a letter "C".

* * * * *